US007288734B2

(12) United States Patent
Shiroshita

(10) Patent No.: US 7,288,734 B2
(45) Date of Patent: Oct. 30, 2007

(54) VEHICLE SWITCH

(75) Inventor: Manabu Shiroshita, Fukui (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/264,449

(22) Filed: Nov. 1, 2005

(65) Prior Publication Data

US 2006/0090991 A1 May 4, 2006

(30) Foreign Application Priority Data

Nov. 2, 2004 (JP) ..... 2004-318963
Oct. 3, 2005 (JP) ..... 2005-289791

(51) Int. Cl.
*H01H 9/02* (2006.01)

(52) U.S. Cl. ..... 200/61.44; 200/333

(58) Field of Classification Search ..... 200/333, 200/329, 61.41–61.44, 61.62–84, 237, 302.1, 200/302.2, 302.3
See application file for complete search history.

(56) References Cited

U.S. PATENT DOCUMENTS 4,492,833 A * 1/1985 Malesko ..... 200/61.78
5,836,442 A * 11/1998 Hirano ..... 200/284
6,396,013 B1 5/2002 Kondo
6,917,003 B2 * 7/2005 Dozono et al. ..... 200/61.44

FOREIGN PATENT DOCUMENTS

JP 2001-035294 2/2001
JP 2002075118 A * 3/2002
JP 2003-146077 5/2003

* cited by examiner

*Primary Examiner*—Elvin Enad
*Assistant Examiner*—M. Fishman
(74) *Attorney, Agent, or Firm*—RatnerPrestia

(57) ABSTRACT

A vehicle switch includes a case having a through-hole through the top face thereof, an operating body, a switch contact, an elastic cover, and a sliding part. The top end of the operating body projects from the through-hole. The operating body is housed in the case vertically movable. The switch contact is brought into and out of electrical contact by the vertical movement of the operating body. The elastic cover covers the through-hole of the case and the top end of the operating body. The sliding part that has a smaller friction coefficient than that of the elastic cover is provided in the top portion of the elastic cover, and covers at least the rim of the top portion of the elastic cover, or protrudes from the top face of the top portion and has an arc-shaped curved surface in the outer periphery of the upper rim thereof.

16 Claims, 8 Drawing Sheets

VEHICLE SWITCH

BACKGROUND OF THE INVENTION

1. Field of the Invention

The present invention relates to switches for a vehicle (hereinafter referred to as vehicle switches) that are incorporated mainly in a vehicle and used to detect whether a door thereof is opened or closed.

2. Background Art

It is widely applied to control turning on and off the lighting apparatuses in a vehicle cabin, by using a vehicle switch incorporated in the door part thereof according to opening and closing operation of the door. In many cases, such a vehicle switch is incorporated in a place exposed to water drops, such as rain, when the door is open; therefore, the vehicle switch is protected from water by a rubber cover or other parts. A description is provided of such a conventional vehicle switch in reference to FIGS. 6 to 8B.

FIG. 6 is a sectional view of a conventional vehicle switch. FIG. 7 is an exploded perspective view thereof. Into outer case 31 that is made of an insulating resin and has through-hole 31A through the top face thereof, inner case 32 is fitted and fixed. Fixed contacts (hereinafter referred to as contacts) 33 and 34 made of metal are embedded in the right and left portions of the inner wall of inner case 32 so that the contacts are opposed to each other.

Operating body 35 made of an insulating resin is housed in inner case 32 so as to be vertically movable. Operating portion 35A at the top end of operating body 35 projects upwardly from through-hole 31A. Both ends of substantially U-shaped movable contact (hereinafter referred to as a contact) 36 that is made of metal and fitted into operating body 35 makes resilient contact with corresponding one of contacts 33 and 34. Contacts 33 and 34 are electrically coupled via contact 36. In this manner, a switch contact is formed.

Coil-like spring 37 is installed between the outer bottom face of operating body 35 and the inner bottom face of inner case 32 so as to slightly be contracted. Spring 37 urges operating body 35 upwardly. Elastic cover (hereinafter referred to as a cover) 38 is substantially shaped like a dome and made of a thin rubber. Cover 38 is attached onto the outer top face of outer case 31 by mounting plate 39 made of a metal plate. Covering through-hole 31A and operating body 35A, cover 38 prevents water or dust from entering into the switch from the gap between outer case 31 and operating body 35. In this manner, the vehicle switch is structured.

This vehicle switch is mounted on the chassis, for example, of a door part of a vehicle. Terminals 33A and 34A of contacts 33 and 34 projecting downwardly from the outer bottom face of inner case 32 are coupled to room lamps, for example, by leads (not shown) via electronic circuits (not shown) of the vehicle.

Next, a description is provided of the operation of this vehicle switch. Closing a door of the vehicle as shown in the sectional view of FIG. 8A brings pressing portion 40 of the door into contact with cover 38, thus pressing the top end of operating portion 35A of operating body 35 while deforming cover 38. Then, while contracting spring 37, operating body 35 moves downwardly, and both ends of contact 36 fitted into operating body 35 leave contacts 33 and 34 as shown in FIG. 8B. This operation turns off the switch contact, thus turning off the room lamp, for example.

In contrast, opening the door brings pressing portion 40 out of contact with cover 38, thus removing depression to operating body 35. For this reason, cover 38 is restored to the state of FIG. 8A by the elastic restoring force thereof. Additionally, the urging force of spring 37 moves contact 36 upwardly along with operating body 35. This operation brings both ends of contact 36 in resilient contact with contacts 33 and 34, thus turning on the switch contact and turning on the room lamp, for example. As described above, the vehicle switch detects whether the door is opend or closed: opening the door turns on the room lamp; and closing the door turns off the room lamp. Such a vehicle switch is disclosed in Japanese Patent Unexamined Publication No. 2003-146077.

However, used for water-proof and dust-proof cover 38 in the conventional vehicle switch is a rubber or other materials that has a large friction coefficient and thus does not slide easily. For this reason, when pressing portion 40 of a door is brought into not perpendicular but oblique contact with cover 38 as shown in FIG. 8B, cover 38 is deformed into a distorted shape as it is pressed. Repeating such operations may break cover 38 and make the inside of the switch water-proof and dust-proof insufficiently.

SUMMARY OF THE INVENTION

A vehicle switch of the present invention includes a case, an operating body, a switch contact, an elastic cover, and a sliding part. A through-hole is formed through the top face of the case. The top end of the operating body projects from the through-hole. The operating body is housed in the case vertically movable. The switch contact is brought into and out of electrical contact by vertical movement of the operating body. The elastic cover covers the through-hole of the case and the top end of the operating body. The sliding part that has a smaller friction coefficient than that of the elastic cover is provided in the top portion of the elastic cover. The sliding part covers at least the rim of the top portion of the elastic cover, or protrudes from the top face of the top portion and has an arc-shaped curved surface in the outer periphery of the upper rim thereof. With this structure, even when a pressing body, such as a door, is brought into oblique contact with the rim of the top portion of the elastic cover, the sliding part slides with respect to the pressing body, and thus elastically deforms the elastic cover in a normal state that is the same as the state in which the cover is pressed perpendicularly. Thus, breakage of the elastic cover is prevented.

DETAILED DESCRIPTION OF THE INVENTION

Figure 1:
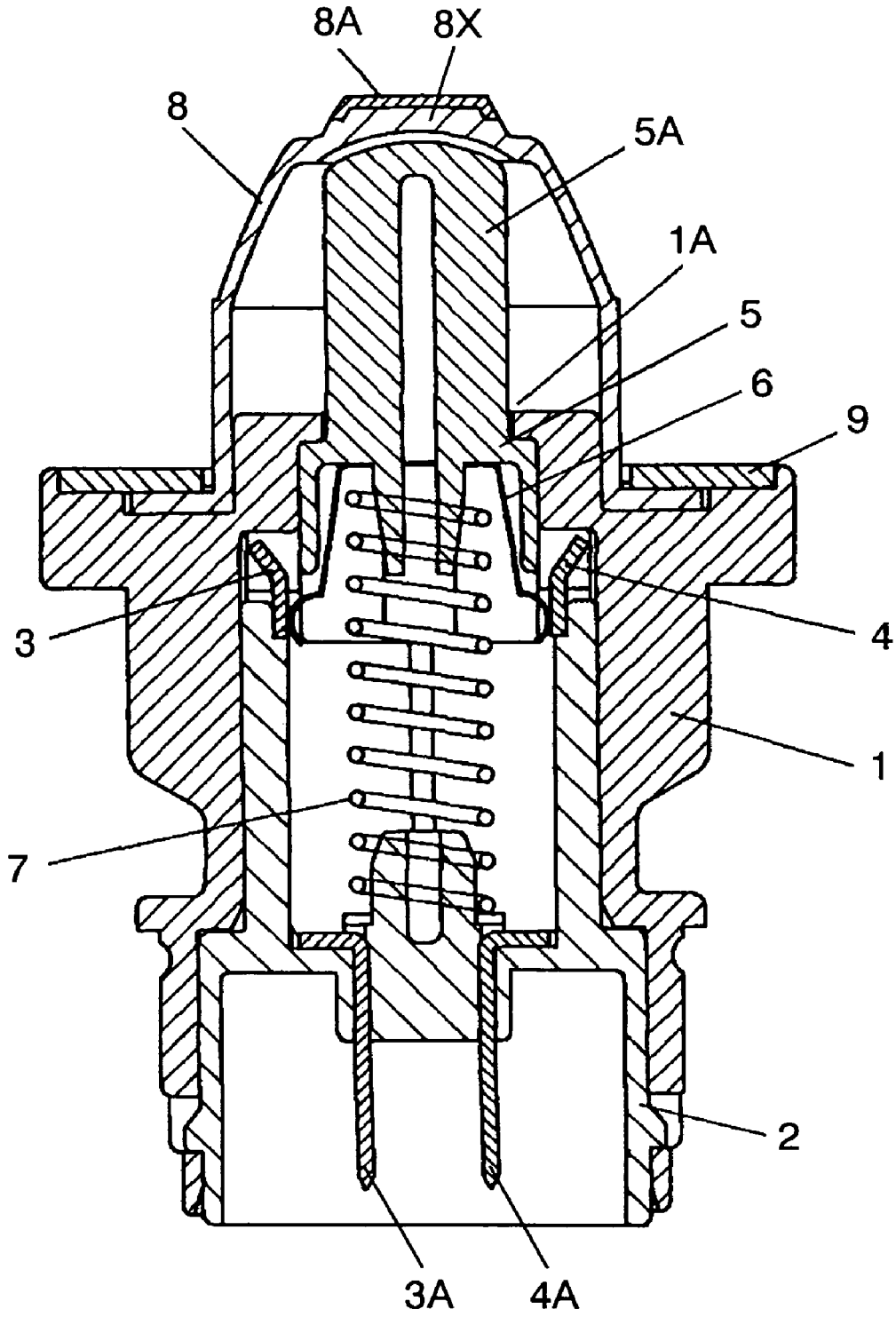
FIG. 1 is a sectional view of a vehicle switch in accordance with an exemplary embodiment of the present invention.
Figure 2:
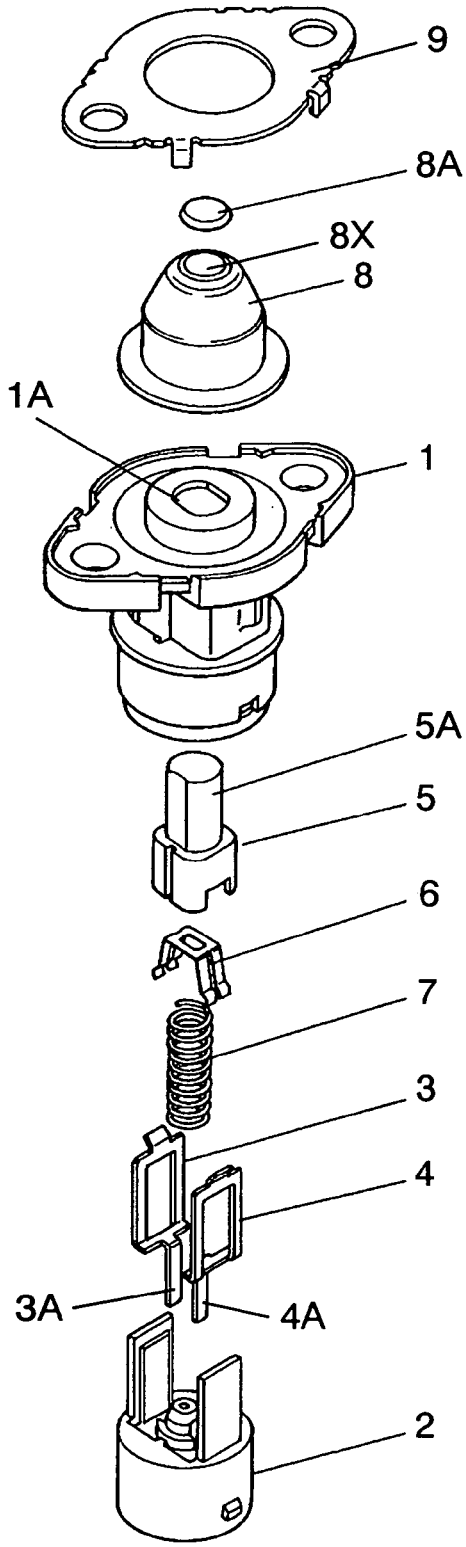
FIG. 2 is an exploded perspective view of the vehicle switch shown in FIG. 1.

FIG. 1 is a sectional view of a vehicle switch in accordance with an exemplary embodiment of the present invention. FIG. 2 is an exploded perspective view thereof. Outer case 1 is substantially shaped like a cylinder and made of an insulating resin, such as polyacetal and polybutylene terephthalate. Through-hole 1A is formed through the top face of outer case 1. Inner case 2F is fitted and fixed into outer case 1. In this manner, outer case 1 and inner case 2 structure a case having through-hole 1A through one face. Additionally, fixed contacts (hereinafter referred to as contacts) 3 and 4 made of metal, such as copper alloy, are embedded in the right and left portions of the inner wall so that the contacts are opposed to each other.

Operating body 5 made of an insulating resin, such as polyacetal and nylon, is housed in inner case 2 vertically movable. Operating portion 5A at the top end of operating body 5 projects from through-hole 1A upwardly. In other words, operating body 5 is housed in the case lineally movable in one direction with one end thereof projecting from through-hole 1A.

Both ends of substantially U-shaped movable contact (hereinafter referred to as a contact) 6 that are fitted into operating body 5 and made of metal, such as cupper alloy, are in resilient contact with contacts 3 and 4. Contacts 3 and 4 are electrically coupled with each other via contact 6. In this manner, contacts 3, 4, and 6 form a switch contact to be brought into and out of electrical contact with one another by the movement of operating body 5.

Coil-like spring 7 made of a steel wire, for example, is installed between the outer bottom face of operating body 5 and the inner bottom face of inner case 2 so as to slightly be contracted. Spring 7 urges operating body 5 upwardly. Elastic cover (hereinafter referred to as a cover) 8 is substantially shaped like a dome made of thin rubber or elastomer. Cover 8 is attached onto the top face of outer case 1 by mounting plate 9 made of metal. Covering through-hole 1A and the top end of operating body 5A, cover 8 prevents water and dust from entering into the switch from the gap between outer case 1 and operating body 5.

Sliding part 8A shaped into substantially circular plate is formed integrally with top portion 8X on the top face of cover 8 therein so as to cover at least the rim of top portion 8X. Cover 8 comprises a non-planar contour. Sliding part 8A protrudes from a top face of top portion 8X of cover 8 and has a smaller friction coefficient than that of cover 8. Sliding part 8A follows the non-planar contour prior to sliding part 8A being pressed with respect to the case. Sliding part 8A is made of tetrafluoroethylene or other materials, which has a smaller friction coefficient than that of cover 8 and thus easily slides. In this manner, the vehicle switch is structured.

Next, a description is provided of steps of manufacturing cover 8 and sliding part 8A formed thereon with reference to the sectional views of FIGS. 3A through 3D. First, flat sheet 21 made of tetrafluoroethylene or the like is pressed using lower punch 22 and upper punch 23 of predetermined shapes as shown on the left in FIG. 3A, so as to have a substantially circular plate part having a substantially U-shaped outer periphery as shown on the center in FIG. 3A. Thereafter, as shown on the right in the drawing, the part formed as above is die-cut using punch 24 into a piece. Manufactured in this manner is substantially circular-plate-shaped sliding part 8A that has an outer periphery bent into a substantially U shape and an arc-shaped curved surface along the outer periphery of the upper rim thereof.

Figure 3A:
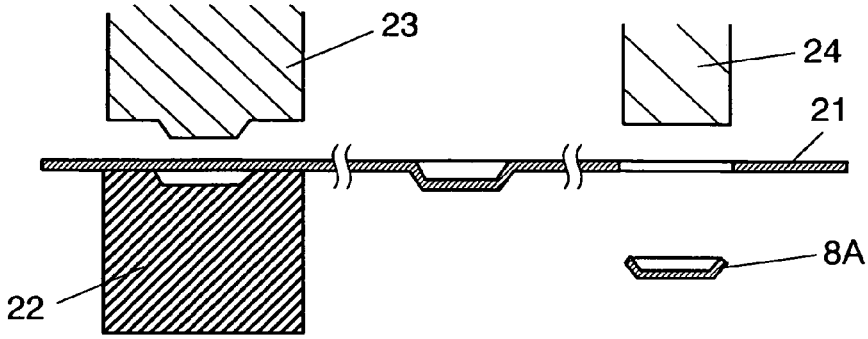
FIGS. 3A through 3D are sectional views, illustrating steps of manufacturing a sliding part and an elastic cover of the vehicle switch shown in FIG. 1.
Figure 3B:
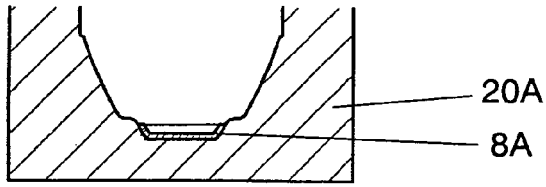
Figure 3C:
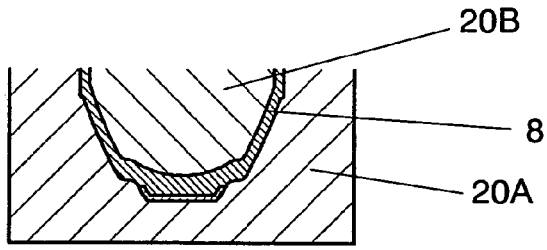
Figure 3D:
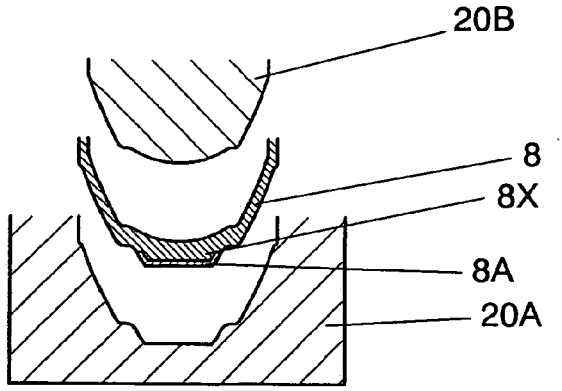

Next, as shown in FIG. 3B, sliding part 8A is placed on the inner bottom face of lower die 20A that is recessed into a shape similar to the outer shape of cover 8, in the portion corresponding to top portion 8X. Then, as shown in FIG. 3C, molding material, such as elastomer, is injection-molded between lower die 20A and upper die 20B that is formed into a shape similar to the inner shape of cover 8. Thereafter, as shown in FIG. 3D, cover 8 is completed so that sliding part 8A is formed integrally with top portion 8X.

When rubber is used as the material of cover 8, a lump of rubber material may be placed on sliding part 8A and compression-molded by heated lower die 20A and upper die 20B to provide cover 8.

An adhesive can be applied to the face in which sliding part 8A is attached to top portion 8X to form sliding part 8A and top portion 8X integrally. By doing so, intimate contact therebetween is further enhanced.

The vehicle switch structured as above is mounted on the chassis, for example, of a door part of a vehicle. Terminals 3A and 4A of contacts 3 and 4 projecting downwardly from the outer bottom face of inner case 2 are coupled to room lamps or other apparatuses by leads (not shown) via electronic circuits (not shown) of the vehicle.

Figure 4A:
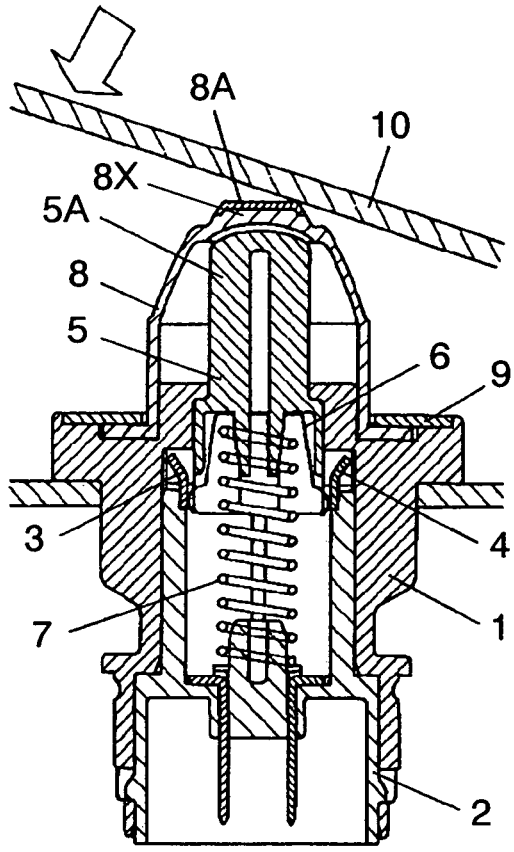
FIGS. 4A and 4B are sectional views when the vehicle switch shown in FIG. 1 is pressed to be operated.

Closing the door of the vehicle brings pressing portion 10 of the door into contact with sliding part 8A as shown in a sectional view of FIG. 4A. While deforming cover 8, pressing portion 10 presses the top end of operating portion 5A of operating body 5.

Sliding part 8A in contact with pressing portion 10 is made of tetrafluoroethylene or the like that has a smaller friction coefficient than that of rubber or the like and thus easily slides. The rim of top portion 8X is covered by sliding part 8A that has an outer periphery bent into substantially a U shape and an arc-shaped curved surface along the outer periphery of the upper rim thereof. With this structure, even when pressing portion 10 approaches top portion 8X obliquely, pressing portion 10 makes contact with the vicinity of the bent portion of sliding part 8A. At this time, sliding part 8A slides on the bottom face of pressing portion 10, thus elastically deforming cover 8 in a normal state that is the same as the state in which the cover is pressed perpendicularly.

In other words, when the upper right end of sliding part 8A is pressed obliquely from the upper right direction as shown in FIG. 4A, cover 8 attempts to be elastically deformed in a distorted shape as it is pressed. However, this pressing force makes sliding part 8A sliding on the bottom face of pressing portion 10 in the left direction. This action elastically deforms cover 8 in a normal shape that is the same as the shape in which pressing portion 10 is pressed perpendicularly as shown in FIG. 4B.

Furthermore, it is preferable that sliding part 8A has an outer periphery bent into a substantially U shape and an arc-shaped curved surface along the outer periphery of the upper rim thereof so as to cover the rim of top portion 8X. In this structure, this arc-shaped curved-face rim allows sliding part 8A to slide more smoothly than a circular-plate-shaped sheet that has a small friction coefficient and an outer periphery of the upper rim shaped like a sharp edge and is attached onto top portion 8X, for example, when pressing portion 10 makes contact with sliding part 8A.

Figure 4B:
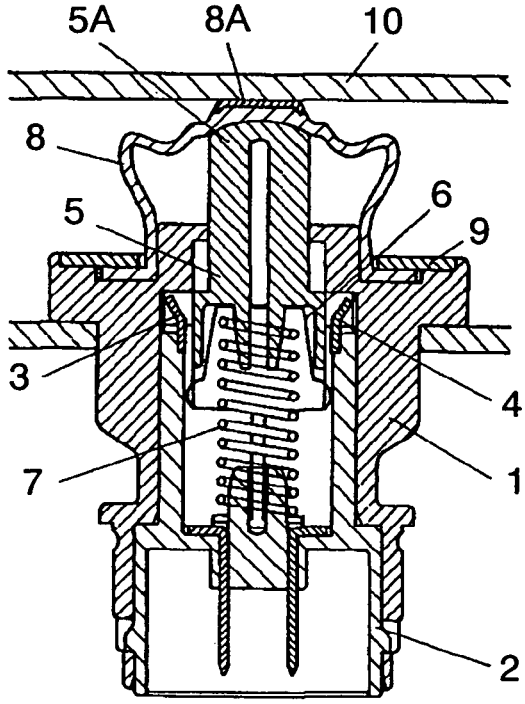

When cover 8 is elastically deformed in a normal shape that is the same as the shape in which cover 8 is perpendicularly pressed, operating body 5 moves downwardly, while contracting spring 7, as shown in FIG. 4B. This action brings both ends of contact 6 fitted into operating body out of contact with contacts 3 and 4. Then, both ends of contact 6 makes in resilient contact with the left and right portions of the inner wall of inner case 2, thus turning off the switch contact. These actions turn off the room lamp, for example.

In contrast, opening the door brings pressing portion 10 out of contact with cover 8, removing depression to operating body 5. Thus, cover 8 is restored to the state of FIG. 4A by the elastic restoring force thereof. The urging force of spring 7 moves contact 6 along with operating body 5 upwardly. Then, both ends of contact 6 make resilient contact with contacts 3 and 4, thus turning on the switch contact. These actions turn on the room lamp, for example.

As described above, the vehicle switch of FIG. 1 has sliding part 8A that has a small friction coefficient and covering the rim of top portion 8X, in top portion 8X of cover 8. Thus, even when pressing portion 10 is brought into oblique contact with cover 8, sliding part 8 slides with respect to pressing portion 10, and thus cover 8 is elastically deformed in the normal state that is the same as the state in which the cover is pressed perpendicularly. This structure prevents breakage of the cover 8, and provides a securely water-proof and dust-proof vehicle switch.

Incidentally, the piece of sliding part 8A may be produced as shown in FIG. 3A, and attached to top portion 8X of cover 8 by an adhesive, for example. However, this production method takes more labor hours than integral formation of sliding part 8A and cover 8 as described with reference to FIGS. 3B through 3D.

Figure 5:
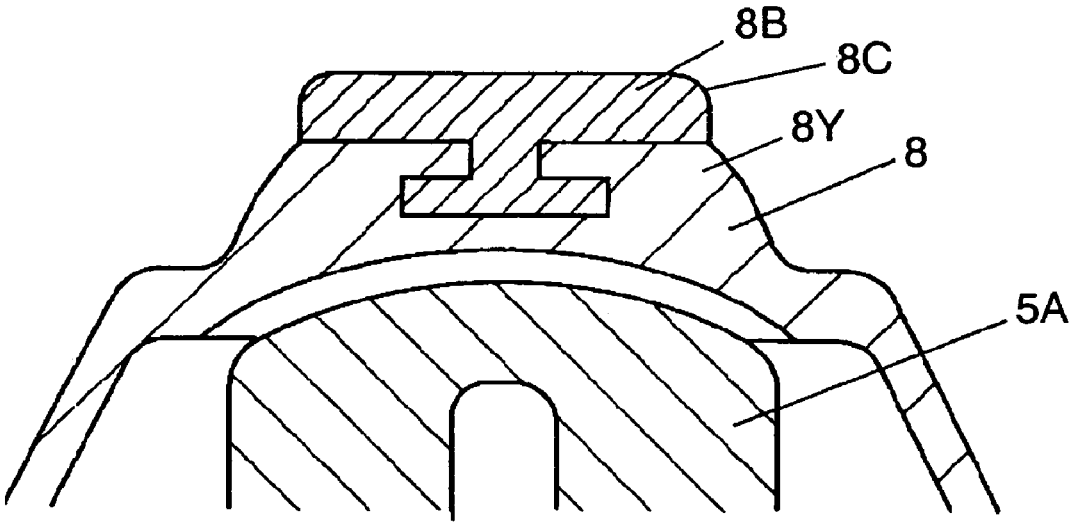
FIG. 5 is a partly sectional view of another vehicle switch in accordance with the exemplary embodiment of the present invention.
Figure 6:
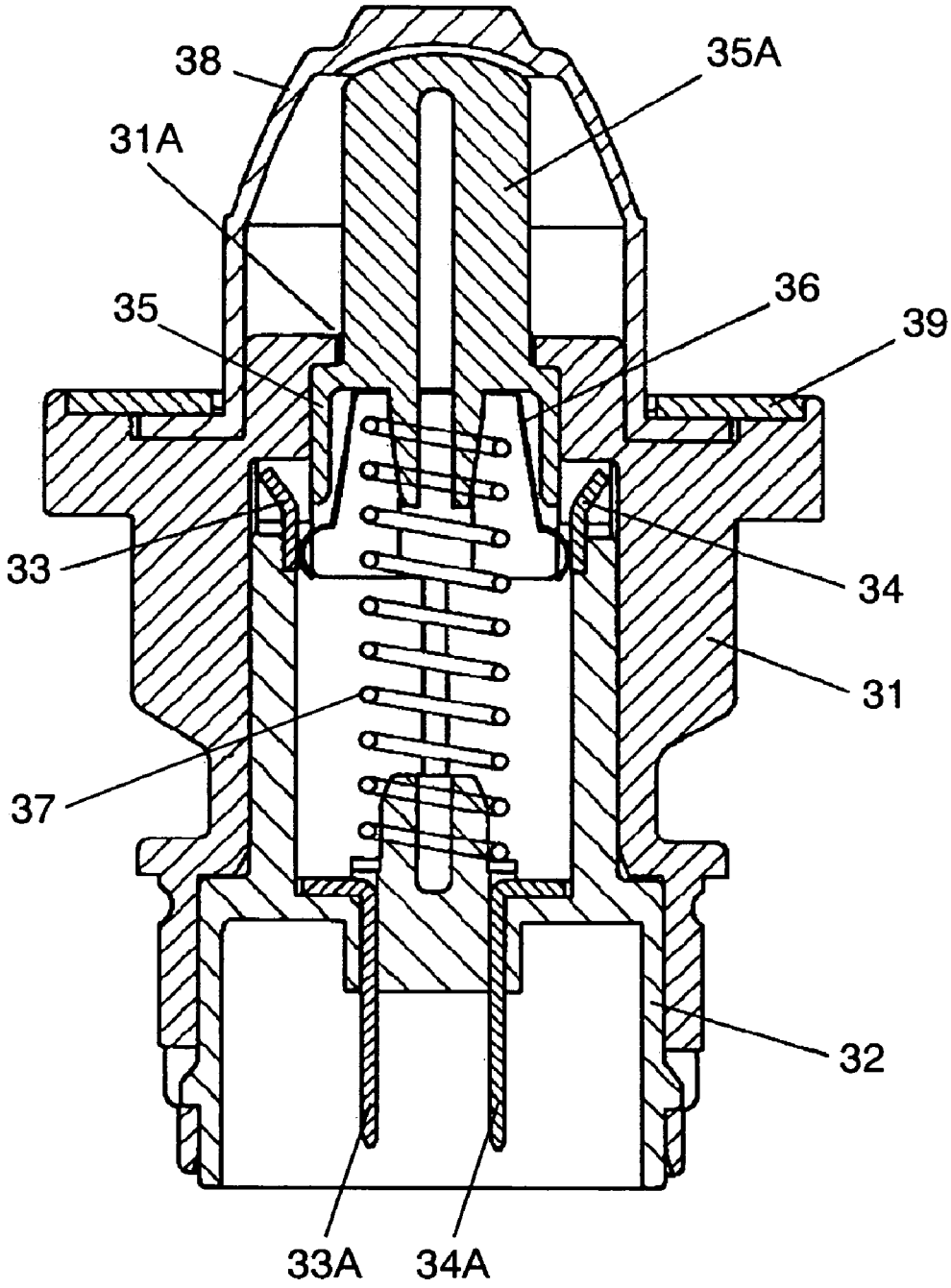
FIG. 6 PRIOR ART
FIG. 6 is a sectional view of a conventional vehicle switch.
Figure 7:
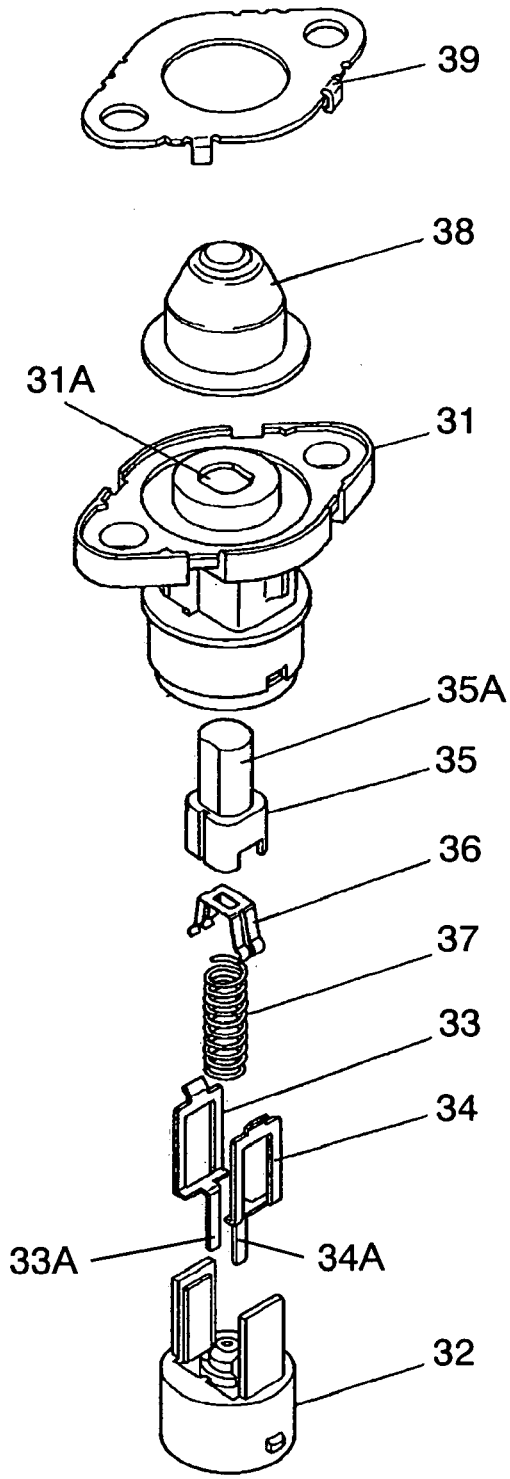
FIG. 7 PRIOR ART
FIG. 7 is an exploded perspective view of the vehicle switch shown in FIG. 6.
Figure 8A:
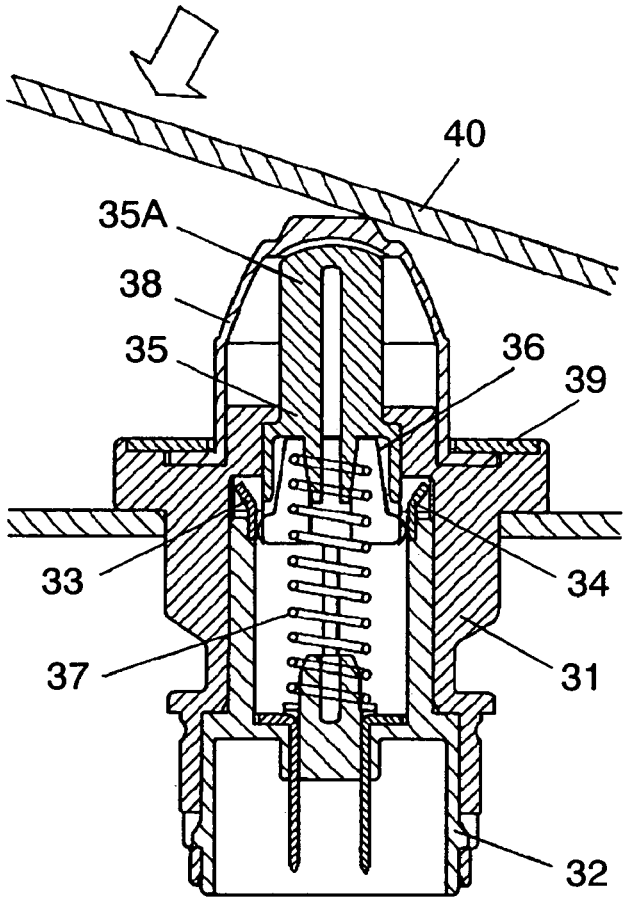
FIG. 8A PRIOR ART
FIGS. 8A and 8B are sectional views when the vehicle switch shown in FIG. 6 is pressed.
Figure 8B:
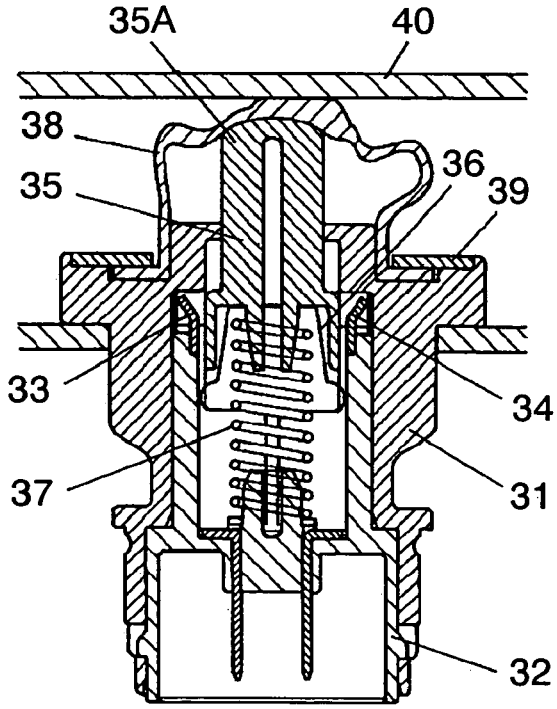
FIG. 8B PRIOR ART

Next, a description is provided of another structure of the sliding part and the cover of this embodiment. FIG. 5 is a sectional view of another vehicle switch in accordance with the exemplary embodiment of the present invention. The lower portion of sliding part 8B substantially disk-shaped is fitted onto the top face of top portion 8Y of cover 8.

Sliding part 8B is made of an insulating resin that has a smaller friction coefficient than that of cover 8 and is more slidable than cover 8, such as acrylonitrile-butadiene-styrene (ABS) copolymer resin and polyoxymethylene. The outer periphery of the upper rim of sliding part 8B protruding from the top face of top portion 8Y has upper rim 8C having a substantially arc-shaped curved surface. The structures other than this portion are the same as those of the vehicle switch of FIG. 1.

In similar to the structure of FIGS. 1, 2, 4A and 4B, when pressing portion 10 of the door approaches top portion 8Y of cover 8 obliquely, pressing portion 10 makes contact with substantially curved-face upper rim 8C of sliding part 8B protruding from the top face of top portion 8Y. At this time, sliding part 8B slides smoothly on the bottom face of pressing portion 10, and thus cover 8 is deformed in a normal state that is the same as the state in which cover 8 is pressed perpendicularly.

The structure of FIG. 1 has sliding part 8A that has a small friction coefficient and covers at least the rim of cover 8, in top portion 8X on the top face of cover 8. On the other hand, the structure of FIG. 5 has sliding part 8B that has upper rim 8C of a substantially arc-shaped curved surface along the outer periphery of the upper rim thereof and protrudes from the top face of top portion 8Y, in top portion 8Y of cover 8. The structure of FIG. 5 provides similar effects to those of the structure of FIG. 1.

Furthermore, sliding part 8B that has upper rim 8C of a substantially arc-shaped curved surface along the outer periphery of the upper rim protrudes from the top face of top portion 8Y in the structure of FIG. 5. With this structure, upper rim 8C of a substantially arc-shaped curved surface in protruding sliding part 8B makes contact with pressing portion 10, and thus sliding part 8B slides more smoothly, even if top portion 8Y is formed into any shape.

As described above, the structure of FIG. 5 has sliding part 8B that has upper rim 8C made of a substantially arc-shaped curved surface formed along the outer periphery of the upper rim and a small friction coefficient, on the top face of top portion 8Y of cover 8. Thus, even when pressing portion 10 is brought into oblique contact with cover 8, sliding part 8B slides with respect to pressing portion 10, and thus cover 8 is elastically deformed in the normal state that is the same as the state in which cover is pressed perpendicularly. This structure prevents breakage of the cover 8, and provides a securely water-proof and dust-proof vehicle switch.

The above description provides a structure in which sliding part 8B is fitted onto top portion 8Y on the top face of cover 8. However, sliding part 8B may be formed integrally with cover 8 by coinjection molding or other methods. Coinjection molding facilitates production of cover 8 and enhances the intimate contact between cover 8 and sliding part 8B.

Additionally, the above description provides a structure in which sliding part 8A or 8B is formed like a substantially circular-plate or disk shape. However, the sliding part may be formed into a substantially ring shape having a central opening. There are various kinds of methods of attaching the sliding part to the top portion, such as integral formation by coinjection molding, and attaching or press-fitting the sliding part separately formed of an insulating resin or other materials.

Further, the above description provides a structure in which substantially U-shaped contact 6 and thin-sheet-like contacts 3 and 4 form a switch contact. However, the present invention is applicable to switch contacts of various kinds of structures, such as opposing a rivet-like fixed contact to a movable contact with predetermined clearances provided therebetween.

As described above, for a vehicle switch of the present invention, breakage of the elastic cover thereof is prevented. This advantage can provide a securely water-proof and dust-proof vehicle switch. This switch is useful to detect whether the door of a vehicle is opened or closed, in addition to other purposes.

What is claimed is:

1. A vehicle switch comprising:

a case having a through-hole formed through one face thereof;

an operating body housed in the case so as to be linearly movable along an axis, and having an end projecting from the through-hole;

a switch contact brought into and out of electrical contact by movement of the operating body;

an elastic cover covering the through-hole of the case and the end of the operating body, the elastic cover comprising a non-planar contour; and a sliding part attached onto a top portion of the elastic cover, covering at least a rim of the top portion, and having a smaller friction coefficient than that of the elastic cover, the sliding part following the non-planar contour prior to the sliding part being pressed with respect to the case.

2. The vehicle switch according to claim 1, wherein the sliding part is formed integrally with the elastic cover.

3. A vehicle switch comprising:

a case having a through-hole formed through one face thereof;

an operating body housed in the case so as to be linearly movable along an axis, and having an end projecting from the through-hole;

a switch contact brought into and out of electrical contact by movement of the operating body;

an elastic cover covering the through-hole of the case and the end of the operating body, the elastic cover comprising_a non-planar contour; and a sliding part protruding from a top face of a top portion of the elastic cover, and having a smaller friction coefficient than that of the elastic cover, the sliding part following the non-planar contour prior to the sliding part being pressed with respect to the case.

4. The vehicle switch according to claim 3, wherein the sliding part is formed integrally with the elastic cover.

5. The vehicle switch according to claim 1, wherein the elastic cover and the sliding part are respectively different materials.

6. The vehicle switch according to claim 3, wherein the elastic cover and the sliding part are respectively different materials.

7. A vehicle switch according to claim 1, wherein the entire sliding part projects from the elastic cover in a direction away from the end of the operating body along the axis.

8. The vehicle switch according to claim 7, wherein the sliding part if formed integrally with the elastic cover.

9. The vehicle switch according to claim 7, wherein the elastic cover and the sliding part are respectively different materials.

10. The vehicle switch according to claim 3, wherein the entire sliding part projects from the elastic cover in a direction away from the end of the operating body along the axis.

11. The vehicle switch according to claim 10, wherein the sliding part is formed integrally with the elastic cover.

12. The vehicle switch according to claim 10, wherein the elastic cover and the sliding part are respectively different materials.

13. The vehicle switch according to claim 1, wherein an outer periphery of an upper rim of the sliding part is made of an arc-shaped curved surface.

14. The vehicle switch according to claim 3, wherein an outer periphery of an upper rim of the sliding part is made of an arc-shaped curved surface.

15. The vehicle switch according to claim 7, wherein an outer periphery of an upper rim of the sliding part is made of an arc-shaped curved surface.

16. The vehicle switch according to claim 10, wherein an outer periphery of an upper rim of the sliding part is made of an arc-shaped curved surface.

* * * * *